US005717372A

United States Patent [19]

Cannon et al.

[11] Patent Number: 5,717,372

[45] Date of Patent: Feb. 10, 1998

[54] DUAL ARMATURE SOLENOID

[75] Inventors: Howard N. Cannon, Gibsonia, Pa.; Mark F. Sommars, Sparland, Ill.

[73] Assignee: Caterpillar Inc., Peoria, Ill.

[21] Appl. No.: 514,641

[22] Filed: Aug. 14, 1995

[51] Int. Cl.[6] ..... H01F 7/00

[52] U.S. Cl. ..... 335/265; 335/119; 251/129.01

[58] Field of Search ..... 335/119, 120, 335/232, 233, 242, 259, 265, 267; 239/585.1–585.5; 251/129.01–129.22

[56] References Cited

U.S. PATENT DOCUMENTS

| | | | |
|---|---|---|---|
| 2,373,256 | 4/1945 | Miller | 335/259 |
| 2,965,954 | 12/1960 | Baker | 29/606 |
| 4,546,955 | 10/1985 | Beyer et al. . | |
| 4,624,282 | 11/1986 | Fargo . | |
| 4,760,694 | 8/1988 | Gillon, Jr. . | |
| 4,778,227 | 10/1988 | Bayliss . | |
| 5,004,162 | 4/1991 | Stettner et al. . | |
| 5,218,996 | 6/1993 | Schmitt-Matzon . | |
| 5,353,991 | 10/1994 | DeNagel et al. . | |

FOREIGN PATENT DOCUMENTS

| | | |
|---|---|---|
| 0661308 | 11/1951 | United Kingdom . |

*Primary Examiner*—Lincoln Donovan
*Attorney, Agent, or Firm*—David M. Masterson

[57] ABSTRACT

A solenoid including a single coil of windings, an immovable stator, and opposed first and second armatures defining an air gap therebetween. A driving circuit energizes the coil to cause the first and second armatures to simultaneously move toward each other from respective first positions to respective second positions.

6 Claims, 3 Drawing Sheets

DUAL ARMATURE SOLENOID

TECHNICAL FIELD

This invention relates generally to a solenoid and, more particularly, to a solenoid that includes a pair of armatures that are actuable in response to the energization of a single coil.

1. Background Art

U.S. Pat. No. 5,353,991 issued to Nagel et al. discloses a solenoid actuated valve assembly that has a first armature that actuates in response to a coil being energized with a positive current, and a second armature that actuates in response to the coil being energized with a negative current.

U.S. Pat. No. 4,760,694 issued to Gillion discloses a solenoid that includes dual telescopic armatures—an inner armature and an outer armature. In response to a low current, the inner armature actuates compressing an inner spring. In response to a high current, the inner armature actuates compressing the inner spring and the outer armature actuates compressing an outer spring; resulting in the inner and outer armatures to move in tandem.

2. Disclosure of the Invention

In one aspect of the present invention, a solenoid includes a single coil of windings, an immovable stator, and opposed first and second armatures. A driving circuit energizes the coil to cause the first and second armatures to simultaneously move toward each other from respective first positions to respective second positions.

BRIEF DESCRIPTION OF THE DRAWINGS

For a better understanding of the present invention, reference may be made to the accompanying drawings in which.

BEST MODE FOR CARRYING OUT THE INVENTION

Figure 1:
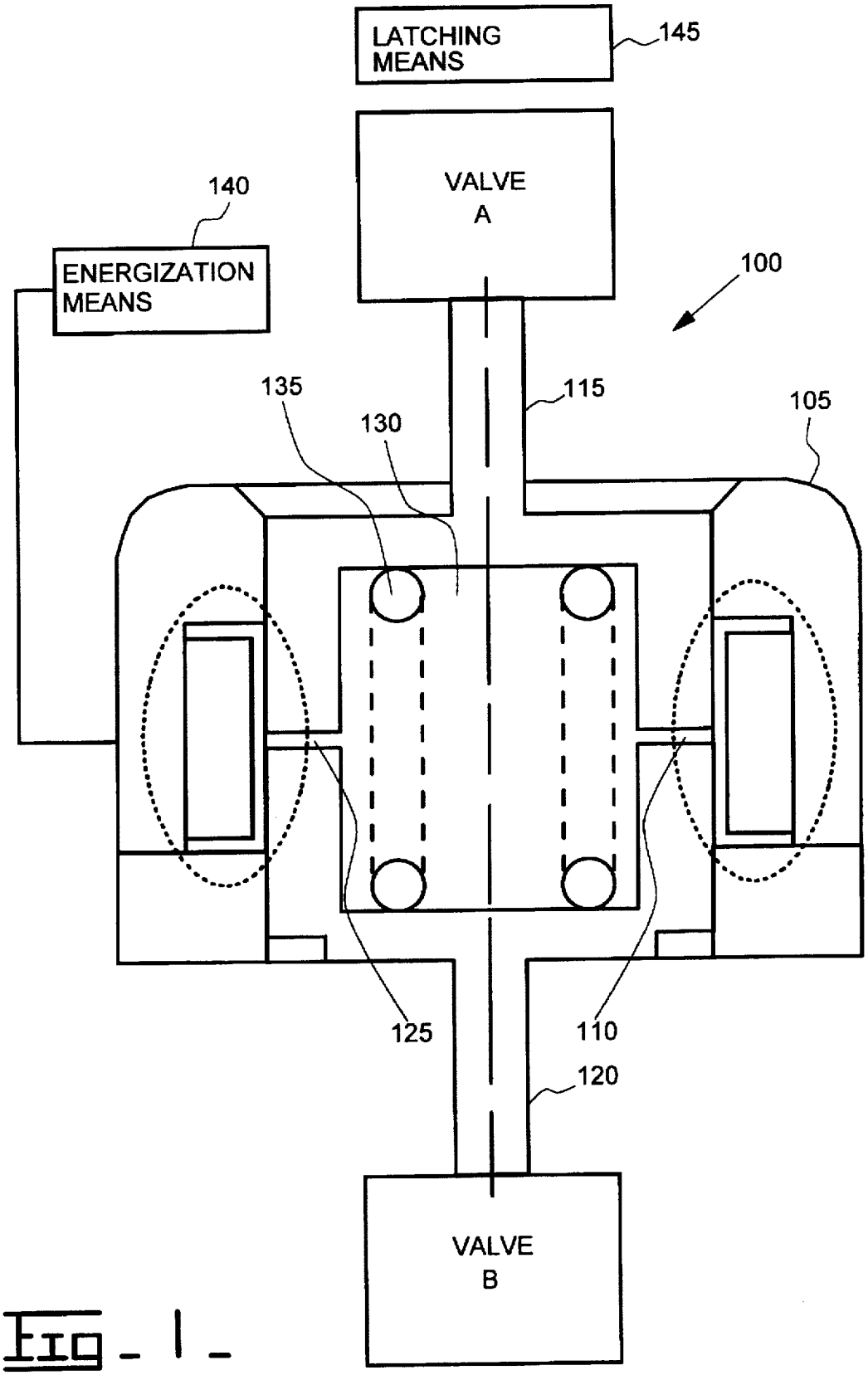
FIG. 1 is a cross sectional view of a first embodiment of a solenoid.

Referring now to the drawings, wherein a first embodiment of the present invention is shown, FIG. 1 illustrates a solenoid 100. The solenoid 100 includes a stator 105 that houses a coil of windings 110. Preferably, the stator 105 is affixed to an immovable object. The solenoid 100 includes first and second armatures 115, 120 that define an air gap 125 therebetween. The first and second armatures 115, 120 additionally define a cavity 130 that houses a return spring 135.

The solenoid 100 may be used to actuate a hydraulic valve assembly. For example, the first armature 115 may be affixed to a hydraulic valve A and the second armature 120 may be affixed to hydraulic valve B. The hydraulic valves A and B may be part of a fuel injector, for example.

A means 140 is provided for energizing the coil 110 in order to generate a magnetic field that causes the first and second armatures 115, 120 to simultaneously move toward each other from respective first positions to respective second positions. For example, in response to electrical current being applied to the coil 110, a magnetic field is generated through the stator 115 and first and second armatures 115, 120. (The magnetic field is shown by the lines shown in phantom.) Because the armatures 115,120 are symmetrical, the magnetic field generates an attractive force at the air gap 125 in equal and opposite directions. Thus, the first and second armatures 115, 120 move simultaneously with equal velocity in response to an energized coil 110. When the coil 110 is de-energized, the return spring biases the first and second armatures 115, 120 to the respective first positions. Note, the energizing means 140 may include any one of a number of well known driving circuits.

In certain applications, e.g., in a fuel injector application, a means 145 may be provided to latch the first armature 115 to the second position (once it is positioned at the second position). The means 145 may include well known hydraulic, magnetic, or mechanical devices that can latch the first armature 115 at the second position. By latching the first armature 115 at the second position, performance characteristics of the solenoid 100 may result. The performance characteristics will be discussed below.

Figure 2:
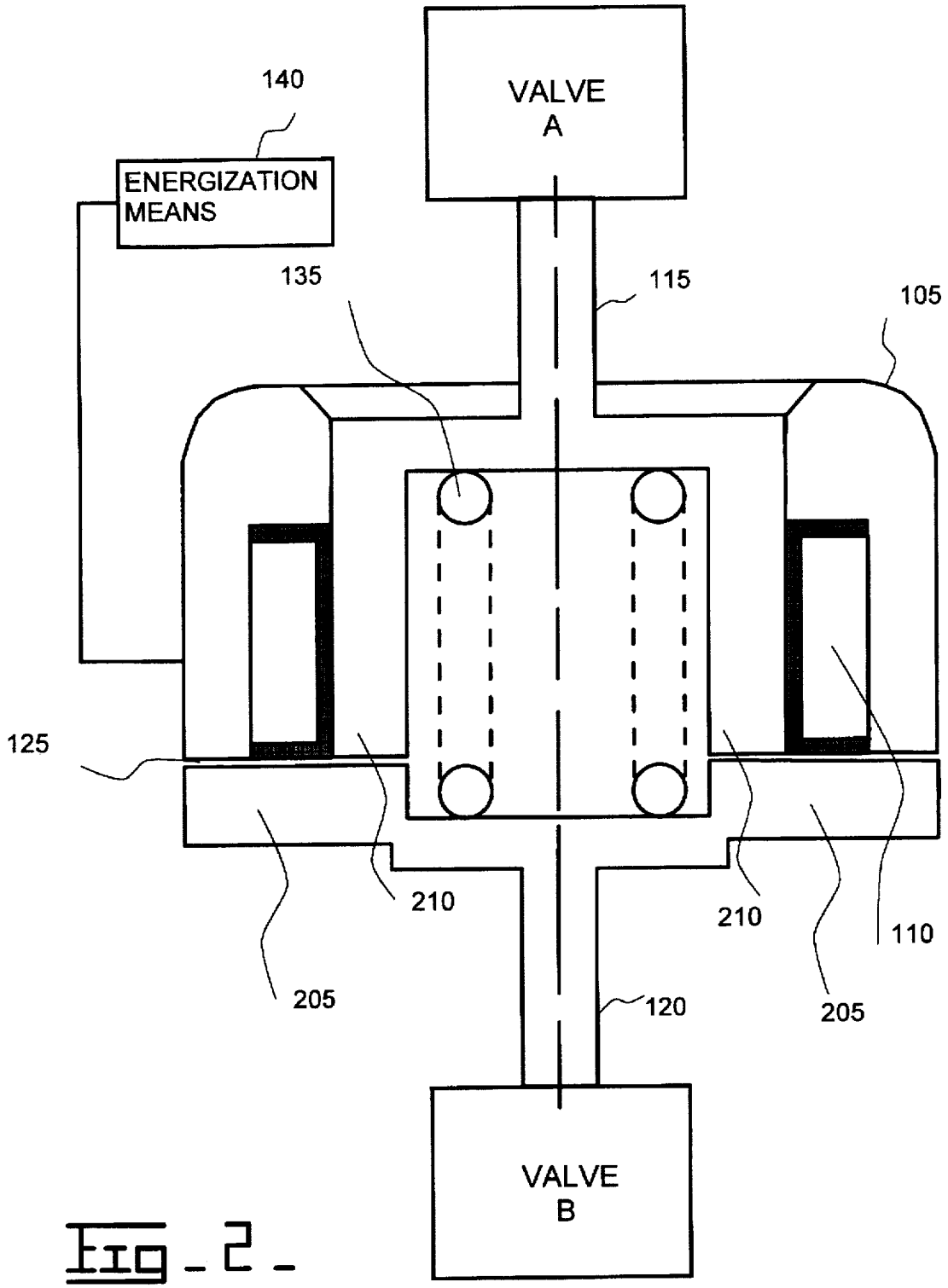
FIG. 2 is a cross sectional view of a second embodiment of a solenoid.

Reference is now made to FIG. 2, which shows another embodiment of the present invention. As shown, the geometry of the first armature 115 is unchanged from the first embodiment. However, the geometry of the second armature 120 has changed from the first embodiment. For example, the second armature 120 defines a pole piece 205 having a greater surface area than the pole piece 210 of the first armature 115. Consequently, a greater magnetic force will act on the second armature 120 than on the first armature 115. This may be useful for applications where the second armature 120 is required to operate at greater speeds than the first armature 115.

Thus, while the present invention has been particularly shown and described with reference to the preferred embodiment above, it will be understood by those skilled in the art that various additional embodiments may be contemplated without departing from the spirit and scope of the present invention.

Industrial Applicability

Figure 3:
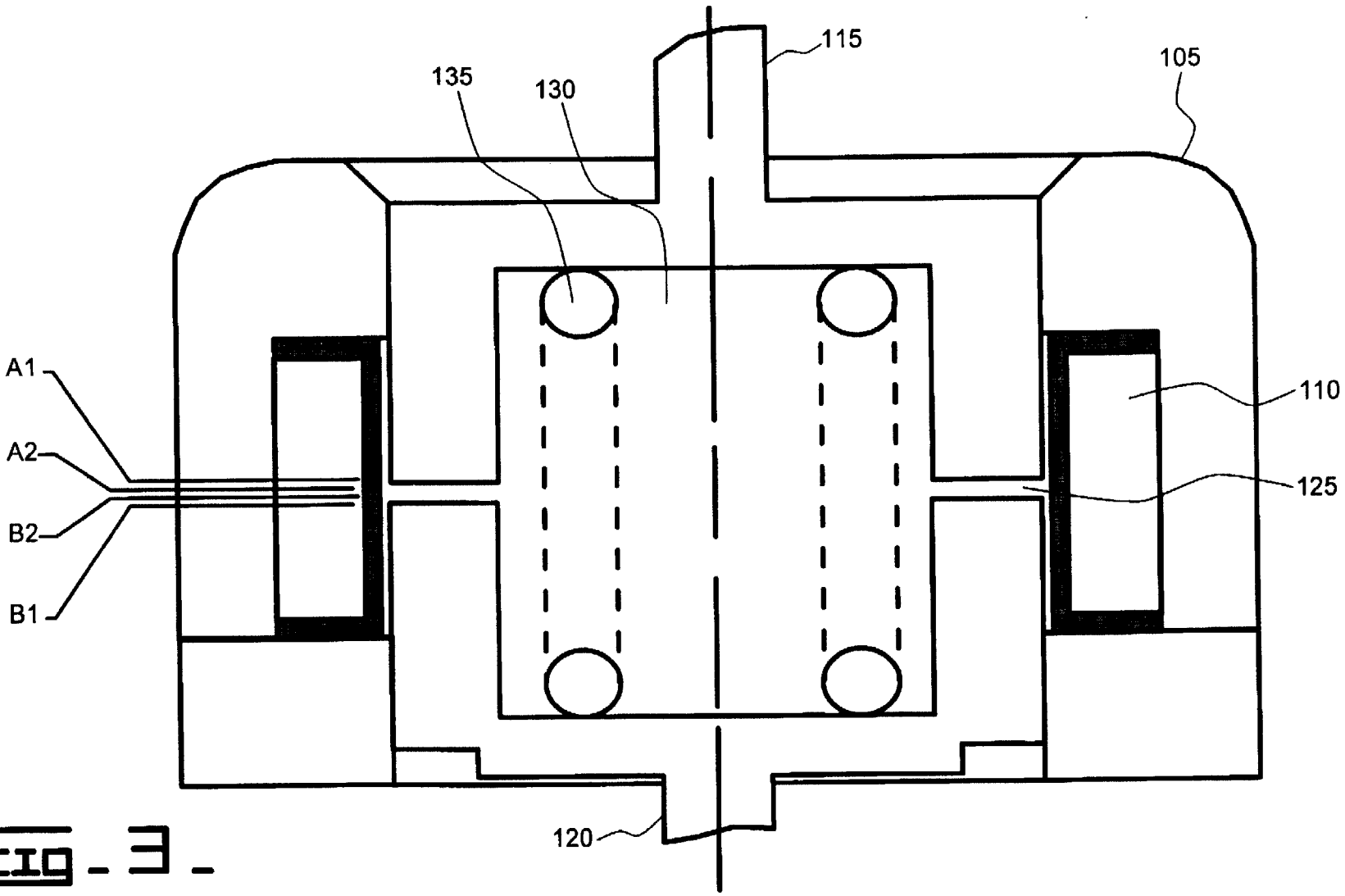
FIG. 3 is an exploded cross section view of the first embodiment of the solenoid.

The operation of the present invention is now described with reference to FIG. 3 to illustrate the features and advantages associated with the present invention. In this example, the intended application for the solenoid 100 is its use in a fuel injector. Here, because it is intended that the first armature 115 be latched at the second position, the solenoid is operated in a sequential manner, as opposed to a simultaneous manner.

In operation, when the coil 135 is energized, the first and second armatures 115, 120 are simultaneously attracted to each other. For example, the first armature 115 moves from a first position (A1) to a second position (A2), which causes valve A to perform one function of the injector. In response to the first armature 115 being at the second position (A2), the latching means 145 latches the first armature 115 at the second position (A2.). Meanwhile, the second armature 120 moves from the first position (B1) to the second position (B2). In response to the coil 135 being de-energized, the return spring biases the second armature 120 to the first position (the first armature 115 remains latched to the second position (A2)). Consequently, the effective air gap has been reduced from the initial air gap due to the first armature 115 being latched to the second position (A2) (The effective air gap is the distance between positions A2 and B1). Therefore, subsequent actuations of the second armature 120 require less energy and occur at a faster rate due to the reduced air gap. Thus, in a fuel injector application, the second armature 120 may be used to produce high speed, short duration fuel injections. This is said to be a sequential operation because the first armature 115 is latched after the initial energization of the coil 110; thereby, reducing the air gap 125 which provides for faster actuations of the second armature 120. In a simultaneous operation, the first and second armatures 115, 120 move simultaneously with each energization of the coil 110.

Other aspects, objects and advantages of the present invention can be obtained from a study of the drawings, the disclosure and the appended claims.

We claim:

1. A method for operating a solenoid, the solenoid including:

a single coil of windings;

an immovable stator; and opposed first and second armatures defining an air gap therebetween; the method including the steps of:

energizing the coil to cause the first and second armatures to move toward each other from respective first positions to respective second positions;

latching the first armature at the second position; and thereafter, energizing and de-energizing the coil to cause the second armature to repeatedly move from the first position to the second position.

2. A method, as set forth in claim 1, including the step of biasing the second armature to the first position in response to the coil being de-energized.

3. A method, as set forth in claim 2, including the step of biasing the first armature to the first position in response to the first armature being de-latched and the coil being de-energized.

4. A solenoid, comprising:

a single coil of windings;

an immovable stator;

opposed first and second armatures defining an air gap therebetween;

means for energizing the coil to cause the first and second armatures to move toward each other from respective first positions to respective second positions; and means for latching the first armature at the second position to reduce the air gap for subsequent actuations of the second armature.

5. An apparatus, as set forth in claim 4, including a spring for biasing the second armature to the first position in response to the coil being de-energized and biasing the first armature to the first position in response to the first armature being de-latched and the coil being de-energized.

6. An apparatus, as set forth in claim 5, wherein the pole piece of the second armature has a greater surface area than the pole piece of the first armature.

* * * * *